United States Patent [19]

Oya et al.

[11] 4,209,494

[45] Jun. 24, 1980

[54] CATALYTIC CONVERTER FOR PURIFYING EXHAUST GASES OF INTERNAL COMBUSTION ENGINES

[75] Inventors: Hiroo Ōya, Ohta; Akio Kakinuma, Ojimamachi, both of Japan

[73] Assignee: Fuji Jukogyo Kabushiki Kaisha, Tokyo, Japan

[21] Appl. No.: 913,024

[22] Filed: Jun. 6, 1978

[30] Foreign Application Priority Data

| | | | |
|---|---|---|---|
| Apr. 8, 1978 | [JP] | Japan | 53/41516 |
| Apr. 8, 1978 | [JP] | Japan | 53/41517 |
| Apr. 8, 1978 | [JP] | Japan | 53/41518 |
| Apr. 8, 1978 | [JP] | Japan | 53/41519 |

[51] Int. Cl.[2] ..... B01J 35/04; B01J 8/02; F01N 3/15

[52] U.S. Cl. ..... 422/179; 422/176; 422/180

[58] Field of Search ..... 23/288 F, 288 FC; 422/176, 179, 180; 60/282, 293, 299, 301, 302

[56] References Cited

U.S. PATENT DOCUMENTS

| | | | |
|---|---|---|---|
| 3,307,920 | 3/1967 | Barnes | 23/288 F |
| 3,780,772 | 12/1973 | Carnanhan et al. | 23/288 FC UX |
| 3,817,714 | 6/1974 | Wiley | 23/288 FC |
| 3,841,842 | 10/1974 | Wiley | 23/288 FC |
| 3,854,888 | 12/1974 | Frietzsche et al. | 23/288 FC |
| 3,912,459 | 10/1975 | Kearsley | 422/179 |
| 3,938,959 | 2/1976 | Matsui et al. | 23/288 FC |
| 3,978,567 | 9/1976 | Vroman | 23/288 FC X |
| 4,002,433 | 1/1977 | Oser | 23/288 FC |
| 4,043,761 | 8/1977 | Gaysert et al. | 23/288 FC |

FOREIGN PATENT DOCUMENTS

| | | | |
|---|---|---|---|
| 968970 | 6/1975 | Canada | 60/299 |
| 2311475 | 10/1973 | Fed. Rep. of Germany | 23/288 FC |
| 2341527 | 3/1974 | Fed. Rep. of Germany | 23/288 FC |
| 2307215 | 8/1974 | Fed. Rep. of Germany | 23/288 FC |
| 2308721 | 8/1974 | Fed. Rep. of Germany | 422/180 |
| 2412863 | 10/1974 | Fed. Rep. of Germany | 23/288 FC |
| 2341265 | 3/1975 | Fed. Rep. of Germany | 23/288 FC |
| 2364425 | 7/1975 | Fed. Rep. of Germany | 23/288 FC |
| 2604886 | 8/1977 | Fed. Rep. of Germany | 23/288 FC |
| 1357241 | 6/1974 | United Kingdom | 60/302 |
| 1437315 | 5/1976 | United Kingdom | 23/288 FC |

*Primary Examiner*—Barry S. Richman

*Attorney, Agent, or Firm*—Martin A. Farber

[57] ABSTRACT

Catalytic converter for purifying the exhaust gases of internal combustion engines comprising a cylindrical shell comprising a pair of half shells which form an inlet chamber, a catalyst chamber, and an outlet chamber, a catalyst element provided in the catalyst chamber, a cylindrical sealing member provided in the inlet chamber, and a damper member provided between the cylindrical shell and the sealing member. The sealing member engages to the cylindrical shell for sealing the gap between the cylindrical shell and the catalyst element.

4 Claims, 13 Drawing Figures

CATALYTIC CONVERTER FOR PURIFYING EXHAUST GASES OF INTERNAL COMBUSTION ENGINES

BACKGROUND OF THE INVENTION

The present invention relates to a catalytic converter for purifying exhaust gases of internal combustion engines.

There are three kinds of catalytic converters, namely a reducing catalytic converter for elimination of nitrogen oxides, an oxidizing catalytic converter for elimination of carbon monoxide and hydrocarbons, and three-way converters for reacting the three noxious elements at the same time. The converters comprise a catalyst bed a pellet type catalyst element or monolithic or honeycomb catalyst element. The monolithic catalyst element is provided in a cylindrical shell, providing resilient supporting means between the cylindrical shell and the element.

The resilient supporting means comprises a wire mesh enclosing the catalyst element and a pair of damper meshes made of wire disposed at opposite ends of the catalyst element, whereby the catalyst element is resiliently supported in the cylindrical shell. Further, the damper mesh at the upstream side of the catalyst element serves as a gas sealing device for preventing the exhaust gases from passing through the gap between the element and the inner wall of the cylindrical shell without contacting the catalyst.

On the other hand, it is difficult to manufacture with precision a cylindrical shell, especially such a cylindrical shell having an oval cross-section and comprising a pair of half shells. Accordingly, the cylindrical shell is liable to have a comparatively large dimensional error. If the gap between the shell and the catalyst element is larger than the tolerance of the converter, sealing the effect of the upstream side damper mesh will decrease.

Further, since the upstream side damper mesh is subjected to the high temperature gases including corrosion components, it has a short lifetime, resulting in early damage to the catalytic converter.

Therefore, it is the object of the present invention to provide a monolithic type catalytic converter having means for compensating the dimensional error of the cylindrical shell and the catalyst element, and thereby providing a converter having a sufficient sealing effect for a long term.

SUMMARY OF THE INVENTION

In accordance with the present invention, the catalyst converter comprises a cylindrical shell comprising a pair of half shells forming an inlet chamber, a catalyst chamber, and an outlet chamber, a monolithic catalyst element resiliently mounted in the catalyst chamber, a cylindrical sealing member provided in the inlet chamber, and a damper mesh provided between the inner wall of the inlet chamber, and the sealing member. The sealing member is pressed against the inner wall of the inlet chamber, thereby sealing the gap between the cylindrical shell and the catalyst element.

Other objects and advantages will be apparent as the present invention is hereinafter described in detail referring to the accompanying drawings, in which.

Figure 4:
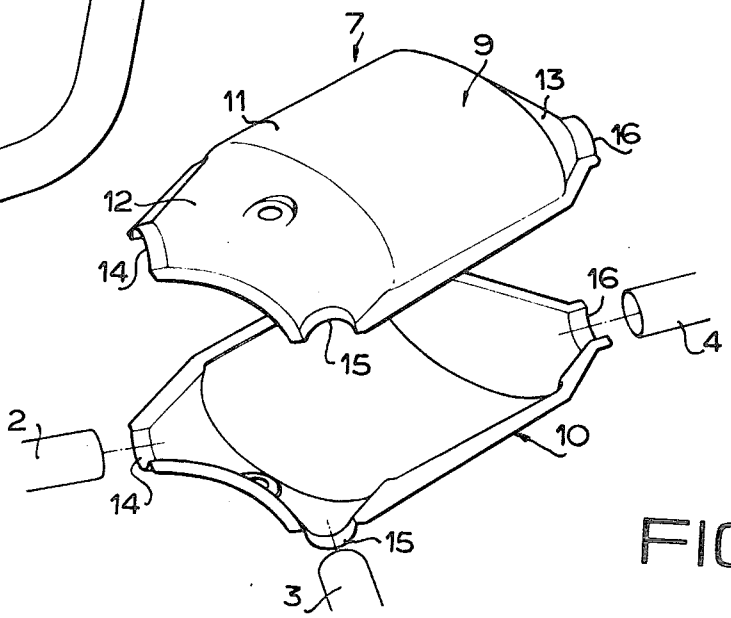
Figure 2:
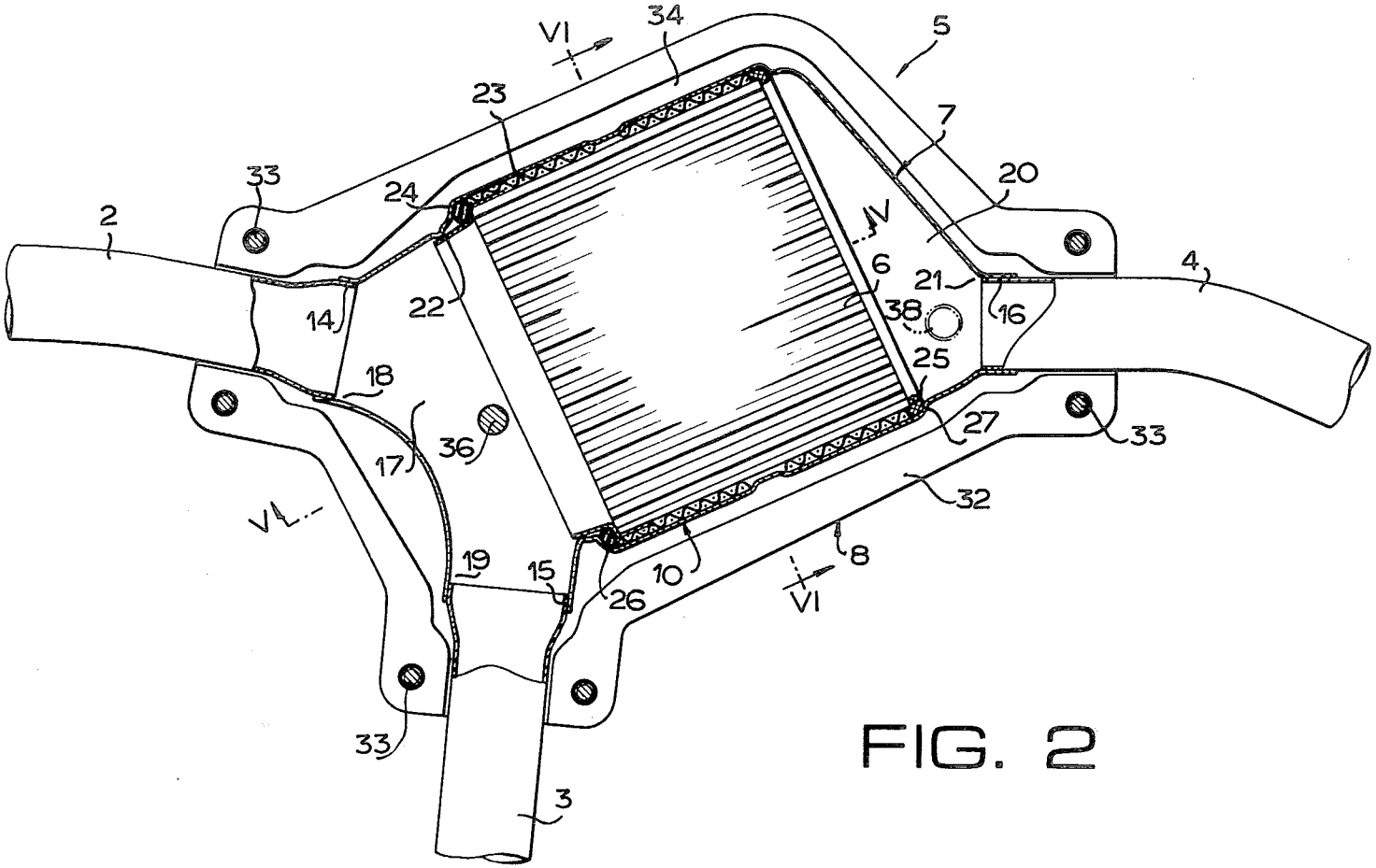
FIG. 2 is a sectional plan view of the catalytic converter shown in FIG. 1.
Figure 3:
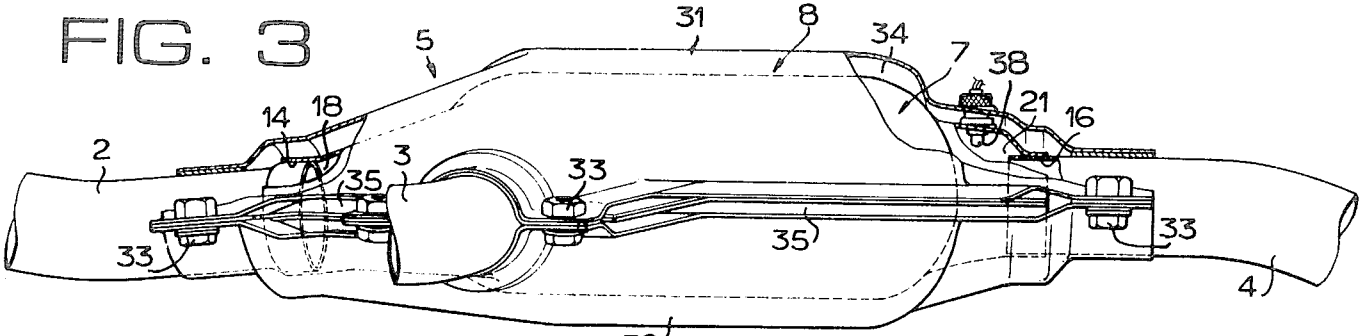
FIG. 3 is a side view of the catalytic converter.
Figure 5:
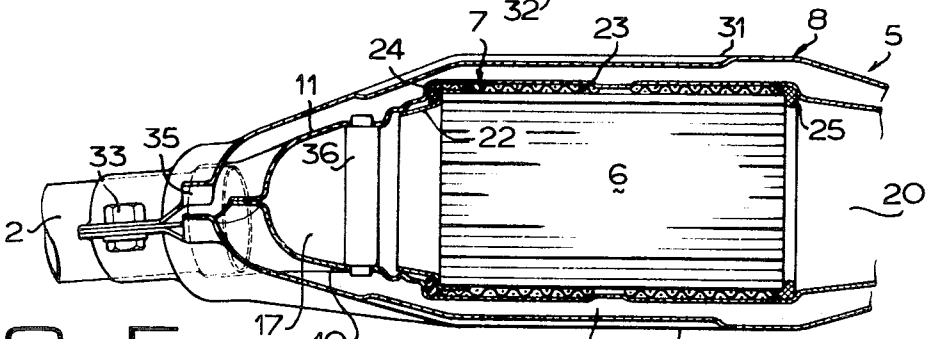
Figure 6:
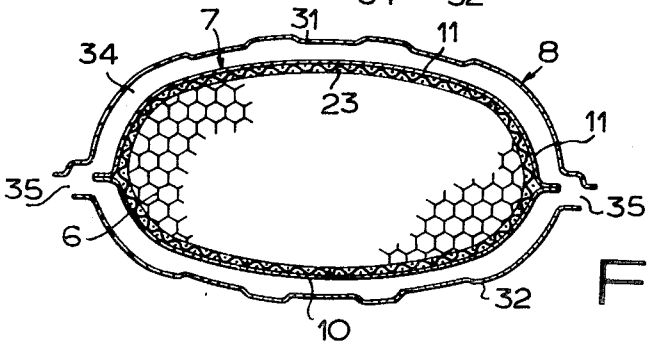
Figure 7:
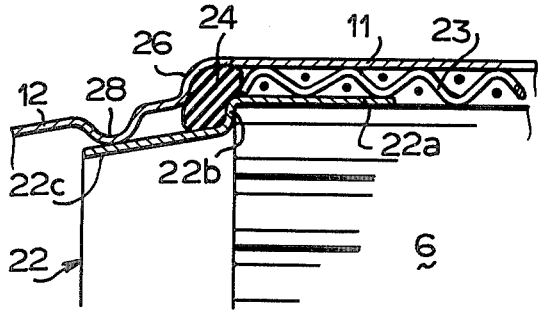
Figure 8:
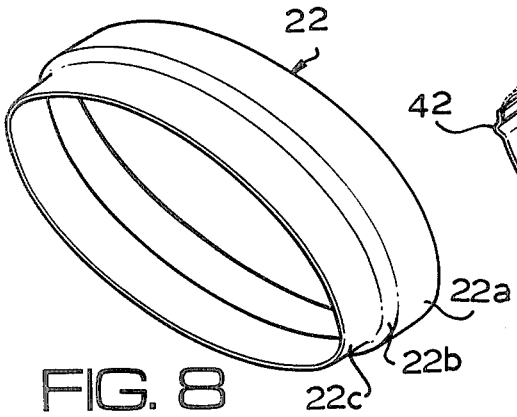
Figure 9:
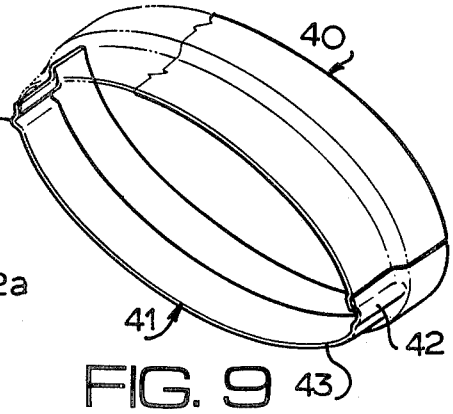
Figure 11:
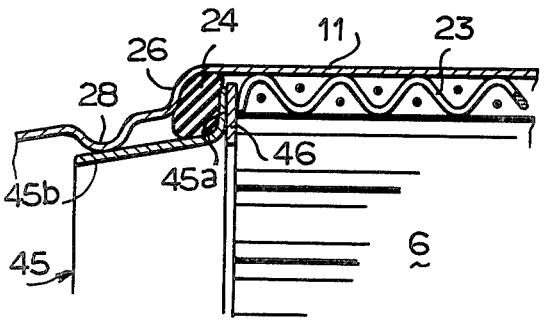
Figure 10:
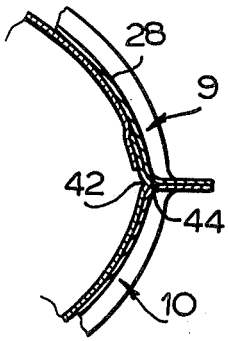
Figure 12:
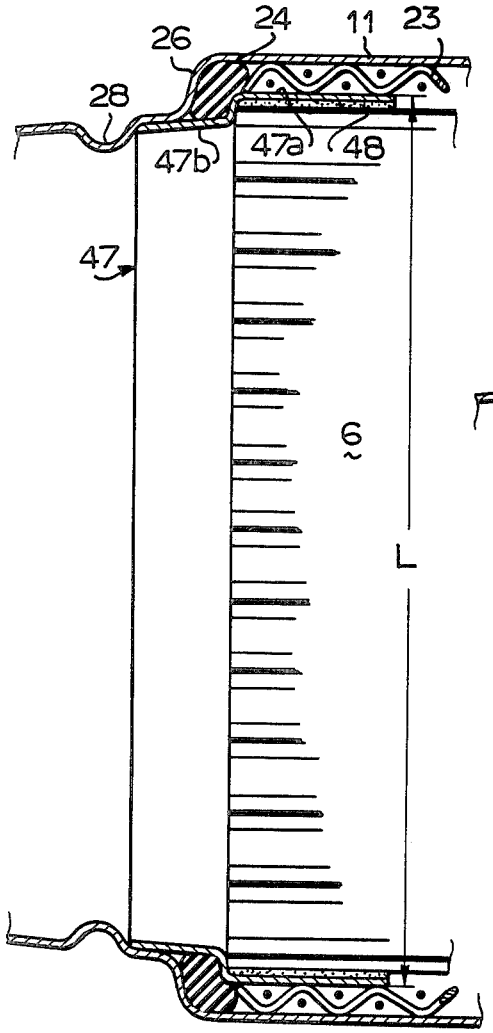
Figure 13:
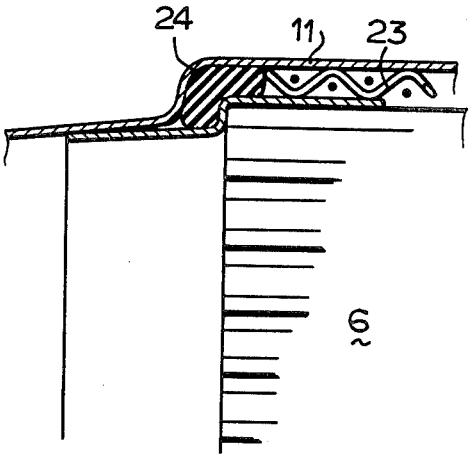

FIG. 4 is a perspective view of shells of the catalytic converter with the parts shown in disassembled relation, FIG. 5 is a sectional view taken along the line V—V in FIG. 2, FIG. 6 is a sectional view taken along the line VI—VI in FIG. 2, FIG. 7 is a sectional view of the front end portion of the catalyst element, FIG. 8 is a perspective view showing a sealing member, FIG. 9 is a perspective view showing a sealing member of another embodiment of the present invention, FIG. 10 is a sectional view showing the overlapped portion of the sealing member in FIG. 9, FIG. 11 is a sectional view of the front end portion of the catalyst element of further embodiment, FIG. 12 is a sectional view showing a part of the converter of another embodiment of the present invention, and FIG. 13 is a sectional view of the front end portion of the converter of further embodiment.

DETAILED DESCRIPTION OF THE INVENTION

Figure 1:
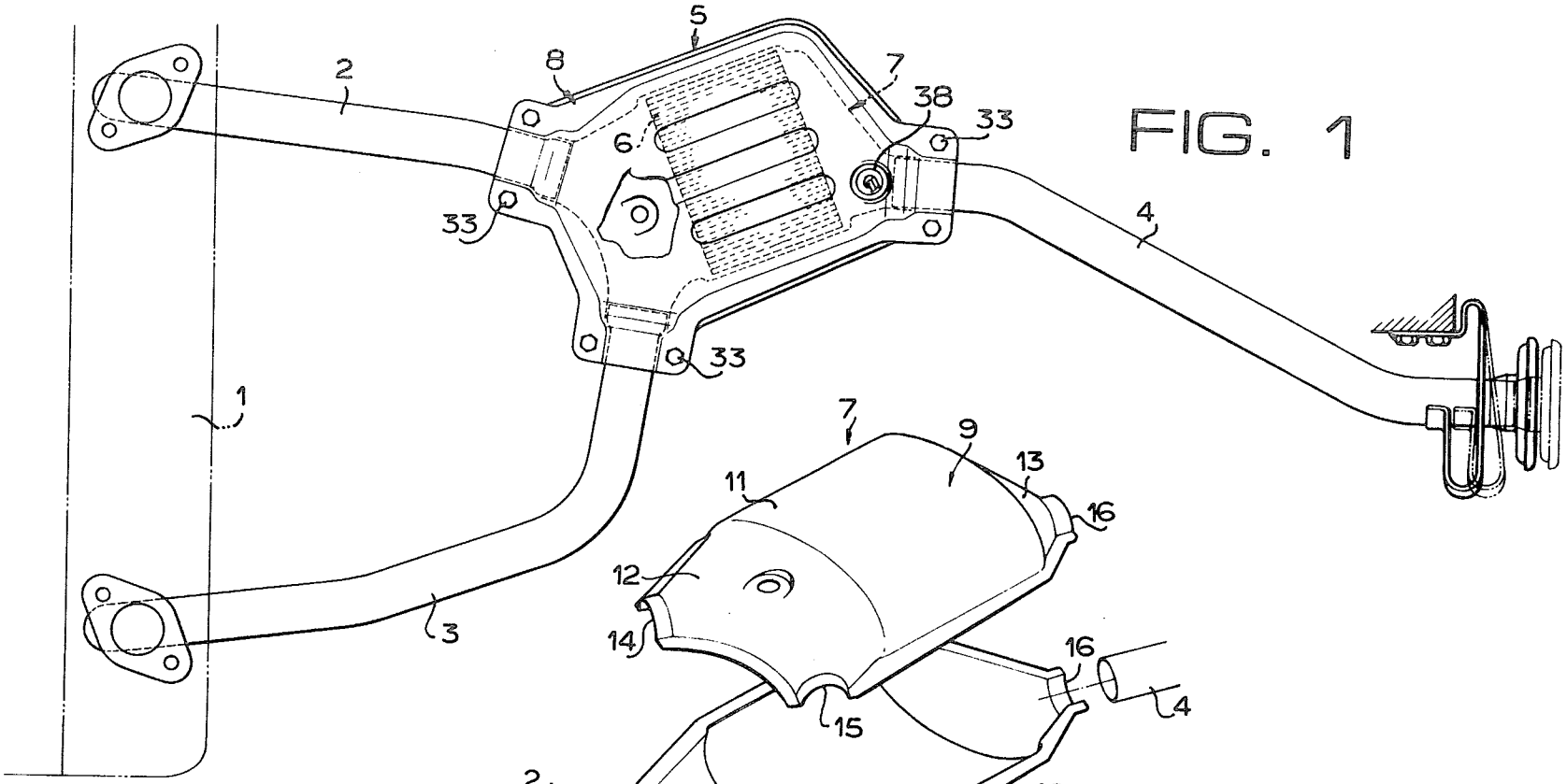
FIG. 1 is a plan view of an apparatus embodying the present invention.

Referring to FIG. 1, an exhaust system in which the catalytic converter of the present invention is applied comprises a bifurcated exhaust pipe comprising two upstream exhaust pipes 2 and 3 connected to a pair of exhaust ports of the engine 1 and a common downstream exhaust pipe 4. Such a bifurcated exhaust pipe, for example, is used in the horizontally opposed-cylinder type engine. At the concourse portion or bifurcation of the exhaust pipes, a catalytic converter 5 of the present invention is provided, which connects each end of the exhaust pipes 2 and 3 to an inlet of the catalytic converter and connects the end of the common exhaust pipe 4 to an outlet thereof.

The catalytic converter 5 comprises a monolithic catalyst element 6 provided in a cylindrical shell 7 having an oval cross section and a protective cover 8, as shown in FIGS. 2 to 6. The catalyst a monolithic three-way catalyst, but other types of catalyst may be used as the converter. The shell 7 comprises a pair of half shells 9 and 10 each of which is made by pressing stainles steel plate. Each of half shells 9 and 10 has a body shell 11, a tapered inlet shell 12, and a tapered outlet shell 13. The inlet shell 12 has a pair of semicircular inlet portions 14 and 15, and the outlet shell 13 has a semicircular outlet portion 16. Thus, by joining both half shells 9 and 10 together, a catalyst chamber is formed by the body shell 11, an inlet chamber 17 is formed by the tapered inlet shells 12, and inlet ports 18 and 19 are formed by the semicircular inlet portions 14 and 15. Further, an outlet chamber 20 is formed by the tapered outlet shells 13 and an outlet port 21 is formed by the semicircular outlet portions 16. Each axial line of the inlet ports 18 and 19 forms an angle with the axial line of the catalyst chamber, as shown in FIGS. 2 and 7, so that the axial lines of both inlet ports cross each other in the inlet chamber 17 a central position near the front end of the catalyst element 6. Further, the outlet port 21 is biased from the axial line of the catalyst chamber and makes an angle with the axial line.

In assembly, the monolithic catalyst element 6 engages a cylindrical sealing member 22 at the upstream end and is wrapped with a wire mesh 23. At the opposite sides of the wire mesh 23, damper meshes 24 and 25 are connected respectively, the damper mesh 24 engaging with the periphery of the sealing member 22. The wrapped catalyst element 6 engages one of the half shells 9 and 10 and the half shells are joined and welded each other. The damper mesh 24 is disposed between the shoulder 26 of the body shell 11 and the shoulder **22*b* of the sealing member 22, and the damper mesh 25 is disposed between the shoulder 27 of the shell and the end of the catalyst element. Thus, the monolithic catalyst element 6 is resiliently maintained by the wire mesh 23 the damper meshes 24 and 25, so that the movement of the catalyst member is prevented and the damper mesh 24 and the sealing member 22 serve as a sealing device for preventing the exhaust gases from passing through the space between the catalyst element and the inner wall of the shell 7**.

Referring to FIGS. 7 and 8, the sealing member 22 comprises a cylindrical portion **22*a* having an oval cross section, a shoulder 22*b* and a tapered sealing portion 22*c* having elasticity. The face of the tapered sealing portion, there is provided an inwardly projected protrusion 28 in each inlet shell 12. The protrusion of one of the inlet shells is adapted to be coupled to the other protrusion of other inlet shell to form a continuous annular protrusion, when both of the half shells 9 and 10 are joined. When the converter is assembled, the continuous annular protrusion is pressed against the periphery of the tapered sealing portion 22*c* of the sealing member, whereby a sealing contact relation between the protrusion and the periphery of the sealing portion 22*c*** may be provided by elastic deformation of the sealing portion. Thus, the sealing effect at the upstream side of the catalyst element can be further guaranteed.

The assembled converter is connected to the upstream exhaust pipes 2 and 3 by engaging the inlet ports 18 and 19 with the pipes and welding same with each other and the downstream exhaust pipe 4 engages the outlet port 21. The converter shell 7 is covered by the protective cover 8 comprising half members 31 and 32. The half members 31 and 32 are joined at the portion surrounding the exhaust pipes 2, 3 and 4 and secured thereto by bolts 33. The peripheral edges of both half members 31 and 32 are disposed apart from each other and there space is provided between the cover 8 and the shell 7. Thus, air may enter the space 34 from the gap 35 between the edges of the half members 31 and 32, thereby cooling the converter during operation. Further, a reinforcement stud 36 in the inlet chamber 17 and a temperature sensitive element 38 is provided in the outlet shell 13 for detecting the temperature of the converter for preventing the burning of the catalyst element.

In operation, exhaust gases enter into the inlet chamber 17 from the inlet ports 18 and 19 alternately in accordance with the firing order of the engine. Since axial lines of the inlet ports cross each other in the inlet chamber 17 as described above, exhaust gases from both inlet ports collide with each other to effect mixing and diffusion of the gases. In addition, since each axial line of the inlet ports makes an angle with the end plane of the catalyst element 6, turbulence or diffusion of the exhaust gases can occur to reduce the flow rate of the gases. Therefore, a uniform flow in the catalyst element and a long residence time may be expected.

In accordance with the present invention, the protrusion 28 of the inlet shell 12 is pressed against the sealing portion **22*c* of the sealing member 22 with elastic deformation of the sealing portion. Thus, dimensional errors of the catalyst element 6 and the half shells 9 and 10 can be compensated by the elastic deformation, which ensures the sealing effect for the gap between the shell and the catalyst element. Therefore, the exhaust gases which enter into the converter can pass through the passages of the catalyst element without leaking through the gap. Further, the sealing means by the protrusion 28 and the sealing portion 22*c* prevents the damper mesh 24** from being subjected to the exhaust gases, whereby the lifetime of the damper mesh may be increased.

FIGS. 9 and 10 show an alternative sealing member. The sealing member comprises a pair of half members 40 and 41 which overlap each other at opposite ends. Each overlapped portion is biased upwardly or downwardly from the joining portion of half shells 9 and 10 and an outwardly projecting protrusion 42 is formed in the tapered sealing portion 43 to engage the gap 44 between the ends of protrusions 28 at the joining portion as shown in FIG. 10. Thus, it is possible to seal the gap and thereby to increase the sealing effect by the protrusions 28.

Referring to the embodiment of FIG. 11 the sealing member 45 comprises a flange **45*a* abutting to an end collar 46 of the catalyst element and a sealing portion 45*b*. The damper mesh 24 is disposed between the shoulder 26 of the body shell 11 and the flange 45*a***.

FIG. 12 shows a further embodiment of the present invention wherein the sealing member 47 comprises a cylindrical portion **47*a* and a sealing portion 47*b*. Dimension "L" of the outer diameter of the cylindrical portion 47*a* is exactly equal to the predetermined dimension of the diameter which is necessary for providing an effective sealing. On the periphery of the end portion of the catalyst element, adhesive 48 such as ceramic cement is applied and the cylindrical portion 47*a* is engages the adhesive layer. The end of the sealing portion 47*b* is pressed against the inner wall of the inlet shell 12 at the position adjacent the downstream side of the protrusion 28. In accordance with this embodiment, since the cylindrical portion 47*a* has a dimension "L" equal to the dimension of the predetermined diameter 6**, the dimensional error of the catalyst element may be corrected. Therefore, a reliable sealing effect may be expected.

Referring to the embodiment of FIG. 13 the sealing member 47 is same as that of FIG. 12. This embodiment is not provided with the protrusion 28 in FIG. 12, but has similar function as FIG. 12.

What is claimed is:

1. A catalytic converter for purifying exhaust gases of an internal combustion engine comprising a cylindrical shell, said cylindrical shell comprising a pair of half shells forming an inlet chamber within which said shell has an inwardly projected annular protrusion, a catalyst chamber and an outlet chamber, a monolithic catalyst element in said catalyst chamber, means for resiliently mounting said monolithic catalyst element in said catalyst chamber, a cylindrical sealing member provided in said inlet chamber adjacent the upstream facing end of said catalyst element, and a damper mesh provided between said cylindrical shell and said sealing member, said sealing member having a sealing portion having elasticity and engaged by said annular protrusion at a position upstream of said damper mesh whereby said sealing portion is pressed against said protrusion at the upstream side of said damper mesh to seal the gap between said shell and said catalyst element.

2. A catalytic converter for purifying exhaust gases of an internal combustion engine comprising a cylindrical shell, said cylindrical shell comprising a pair of half shells forming an inlet chamber, a catalyst chamber and an outlet chamber, said cylindrical shell having a shoulder, a monolithic catalyst element in said catalyst chamber, means for resiliently mounting said monolithic catalyst element in said catalyst chamber, a cylindrical sealing member provided in said inlet chamber adjacent the upstream facing end of said catalyst element, said sealing member having a shoulder, and a damper mesh provided between said shoulders, said sealing member having a sealing portion having elasticity and positioned to abut and be engaged by said cylindrical shell as a position upstream of said damper mesh whereby said sealing portion is pressed against said cylindrical shell at the upstream side of said damper mesh to seal the gap between said shell and said catalyst element.

3. A catalyst converter in accordance with claim 2 in which said sealing member comprises a pair of half members which are overlapped at opposite ends.

4. A catalytic converter for purifying exhaust gases of an internal combustion engine comprising a cylindrical shell, said cylindrical shell comprising a pair of half shells forming an inlet chamber, a catalyst chamber and an outlet chamber, said cylindrical shell having a shoulder, a monolithic catalyst element in said catalyst chamber, means for resiliently mounting said catalyst element in said catalyst chamber, a cylindrical sealing member provided in said inlet chamber adjacent the upstream facing end of said catalyst element, said sealing member having a radially outwardly extending annular flange and a damper mesh provided between said shoulder of said cylindrical shell and said flange of said sealing member, said sealing member having a sealing portion having elasticity and positioned to abut and be engaged by said cylindrical shell at a position upstream of said damper mesh, whereby said sealing portion is pressed against said cylindrical shell at the upstream side of said damper mesh to seal the gap between said shell and said catalyst element.

* * * * *